US008446327B2

(12) United States Patent
Vassilakis et al.

(10) Patent No.: US 8,446,327 B2
(45) Date of Patent: May 21, 2013

(54) COMPOUND TWO-WAY ANTENNA WITH INSTALLATION COMPENSATOR

(75) Inventors: Bill Vassilakis, Orange, CA (US); Nikolai Maslennikov, Huntington Beach, CA (US); Alexander Rabinovich, Cypress, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 1148 days.

(21) Appl. No.: 12/361,307

(22) Filed: Jan. 28, 2009

(65) Prior Publication Data

US 2009/0195467 A1 Aug. 6, 2009

Related U.S. Application Data

(60) Provisional application No. 61/063,215, filed on Feb. 1, 2008.

(51) Int. Cl.
*H01Q 3/00* (2006.01)

(52) U.S. Cl.
USPC ..... 343/765; 343/757

(58) Field of Classification Search
USPC ..... 354/757, 765, 766, 872, 878
See application file for complete search history.

(56) References Cited

U.S. PATENT DOCUMENTS 5,517,205 A * 5/1996 van Heyningen et al. .... 343/765
2008/0258971 A1 * 10/2008 Nichols et al. ..... 342/359

* cited by examiner

*Primary Examiner* — Tan Ho
(74) *Attorney, Agent, or Firm* — OC Patent Law Group

(57) ABSTRACT

A two-way terrestrial antenna, employing electrical down tilt and azimuth beam adjustment capability is disclosed. Such antenna configuration allows for a variable antenna coverage footprint within designated coverage sector. To compensate for installation support structure variations the two-way antenna employs a positional sensor that can provide feedback to BTS or automatically compensate azimuth and tilt beam angles so as to provide uniform sector coverage. In particular by monitoring tri-vector gravitational inclinometer and earth magnetic field sensors, and determining correction factors for antenna tilt and azimuth beam adjustments, uniform or compensated sector coverage is provided.

18 Claims, 6 Drawing Sheets

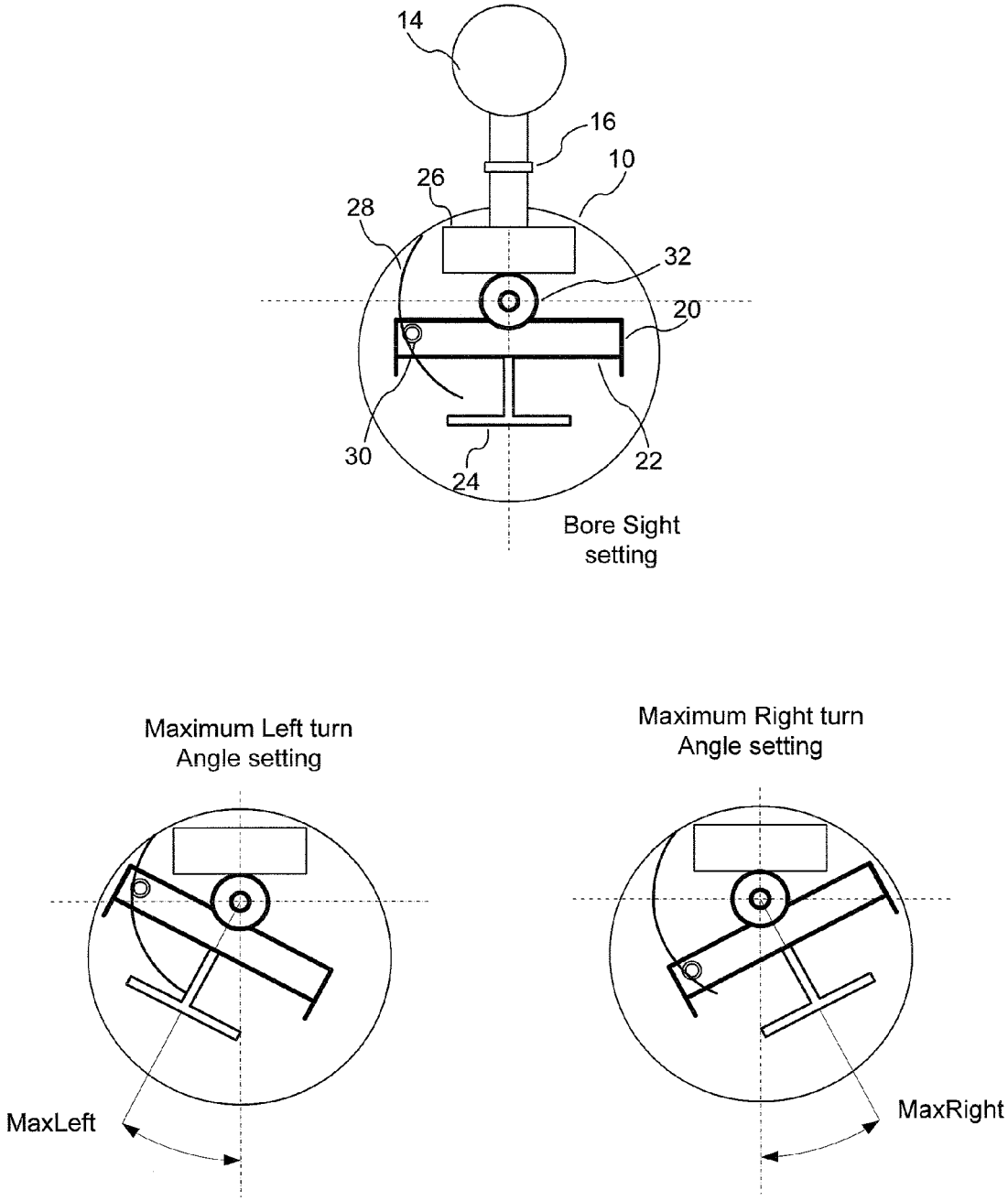
Figure 3A-C

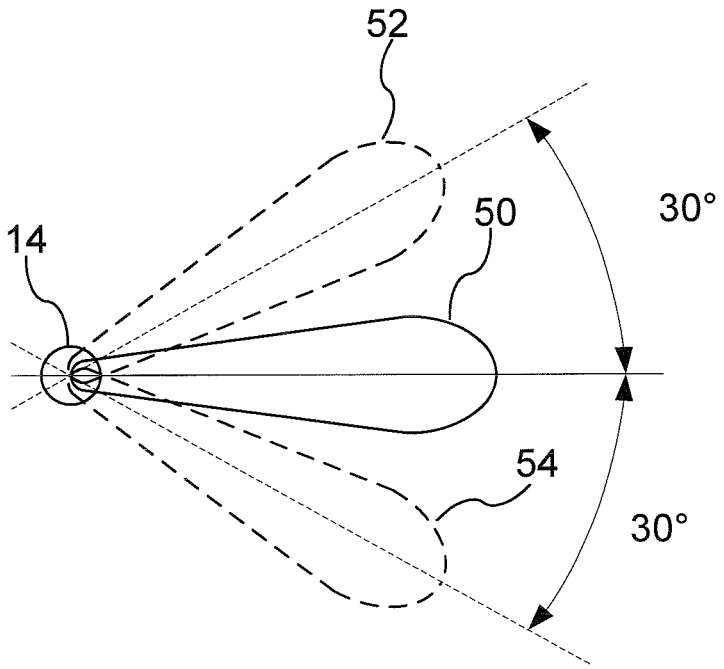
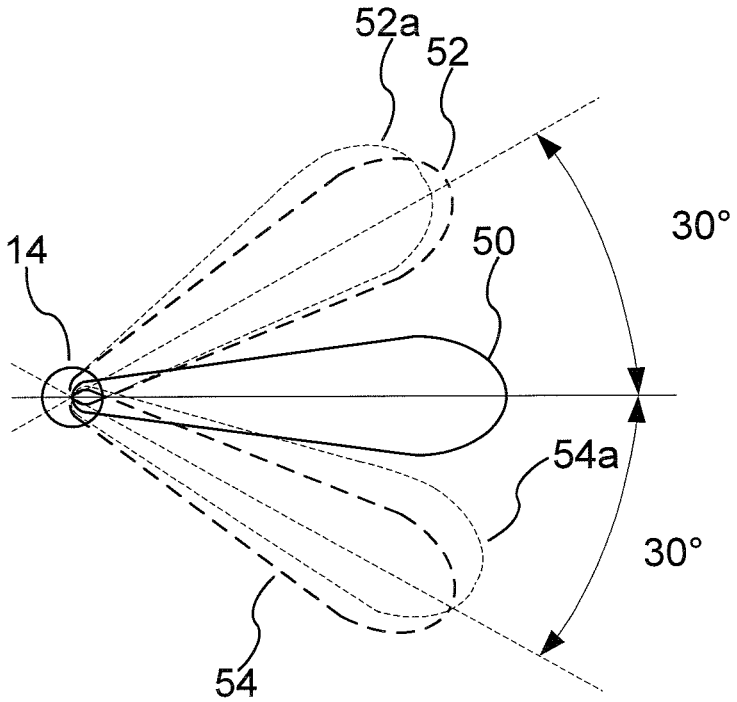
Figure 4A-B

COMPOUND TWO-WAY ANTENNA WITH INSTALLATION COMPENSATOR

RELATED APPLICATION INFORMATION

The present application claims the benefit under 35 USC 119(e) of U.S. provisional patent application Ser. No. 61/063,215 filed Feb. 1, 2008, the disclosure of which is incorporated herein by reference in its entirety.

BACKGROUND OF THE INVENTION

1. Field of the Invention

The present invention relates in general to communication systems and components, and related methods. More particularly the present invention is directed to antenna systems for wireless communication networks.

2. Related Background Information

The coverage area offered by an antenna in a wireless communication network is dependent on the installation facilities, for example antenna tower, or other suitable support structure. In less than ideal circumstances such antenna support structure may have a mounting surface which is not vertical—i.e. having a compound angle deviation from vertical z-axis. When a two-way antenna is installed on a non-vertical support the effective coverage area offered by such antenna is no longer uniform, depending on azimuth and down tilt settings as commanded by network operator. This causes a difficulty in providing the desired coverage in a consistent manner due to unpredictable installation variations.

SUMMARY OF THE INVENTION

In a first aspect the present invent the provides an antenna system comprising an antenna support structure, an antenna including one or more radiating elements, and an antenna mounting structure coupling the antenna to the antenna support structure, the antenna mounting structure including a movable mount allowing change of the antenna orientation. The antenna system further includes an antenna position sensor module mounted on the antenna for detecting at least one of vertical and azimuth orientation relative to the earth, wherein the antenna orientation is adjustable in response to the detected orientation relative to the earth.

In a preferred embodiment of the antenna system the antenna position sensor module comprises an earth gravitational field sensor detecting inclination of the module from vertical. The antenna tilt may be adjusted in response to the detected inclination from vertical and/or the antenna azimuth orientation may be adjusted in response to the detected inclination from vertical. The adjusting may be responsive to a remotely provided tilt control signal. Alternatively, the antenna position sensor module may further comprise a microprocessor for determining a tilt adjustment from the detected inclination and controlling the adjusting. Similarly, the azimuth adjusting may be responsive to a remotely provided azimuth control signal or the antenna position sensor module may further comprise a microprocessor for determining an azimuth adjustment from the detected inclination and controlling the adjusting. Alternatively, or in combination, the antenna position sensor module may comprise an earth magnetic field sensor. The antenna position sensor may further comprise a microprocessor for converting the detected magnetic field into a horizontal component which is used for deriving an azimuth orientation of the antenna. The antenna support structure may for example comprise a pole. The antenna system may further comprise a radome and the radiating elements and antenna position sensor module are mounted in the radome. The antenna system may further comprise an electromechanical actuator coupled to move the radome about the movable mount in response to a control signal. For example, the electromechanical actuator may comprise a motor and gear coupled to the radome.

In another aspect the present invention provides an antenna orientation control system. The antenna orientation control system comprises an orientation sensor for detecting orientation relative to the gravitational or magnetic field of the earth and an antenna orientation controller for providing control signals to control adjusting antenna orientation.

In a preferred embodiment of the antenna orientation control system the antenna orientation controller provides antenna tilt control signals. The antenna actuator controller may also, or alternatively, provide antenna azimuth pointing direction control signals. The antenna orientation control system may further comprise a microprocessor unit for receiving sensor output signals from the orientation sensor and converting them to the control signals. Alternatively the antenna orientation control system may comprise a microprocessor unit for receiving sensor output signals from the orientation sensor and providing the signals to an external base station, wherein external control signals are received from the base station and provided to the antenna orientation controller.

In another aspect the present invention provides a method for controlling the orientation of an antenna. The method comprises receiving sensor information corresponding to detected orientation relative to the earth's gravitational or magnetic field and adjusting the orientation of an antenna in response to the detected orientation relative to the earth.

Further features and advantages of the present invention will be appreciated from the following detailed description of the invention.

BRIEF DESCRIPTION OF THE DRAWINGS

FIG. 3A-C is a top view of a two way antenna of the present invention configured at various azimuth angle settings.

FIG. 4A-B provides effects of the support structure deviation from vertical (Z-Axis) direction on the effective antenna coverage footprint.

DETAILED DESCRIPTION OF THE INVENTION

The present invention provides an antenna system and method with uniform or compensated sector coverage by monitoring tri-vector gravitational inclinometer and earth magnetic field, determining correction factors for antenna tilt and azimuth beam adjustments. Optionally, azimuth antenna beamwidth can be compensated in addition to antenna down tilt angle and azimuth direction of antenna beam. The latter can be used with a three-way antenna. In preferred embodiments of the present invention, tri-vector gravitational inclinometer and earth magnetic field sensors are provided together with a microprocessor for calculating correction factors for the two-way antenna control parameters.

Figure 1:
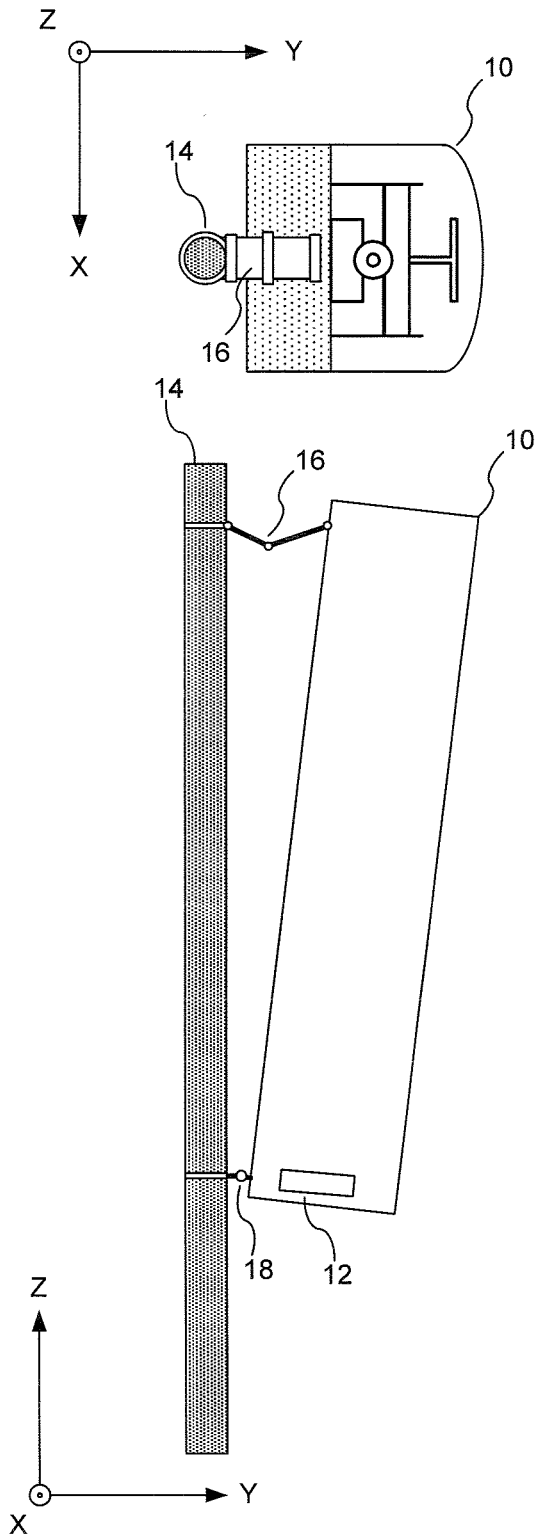
FIG. 1 is top and side view of an embodiment of the antenna of the present invention configured in a typical installation provided for a two-way antenna.

FIG. 1 shows a top and a side view of an antenna array (10) enclosed in a suitable radome according to an exemplary implementation of the present invention, which utilizes an antenna position sensor module, APS, (12) for determining antenna inclination and azimuth angle based on earth's magnetic field and tri-vector gravitational field measurements. Antenna array (10) is conventionally mounted to a vertically oriented support structure (14) using bottom (18) and top (16) mounting brackets.

Figure 2:
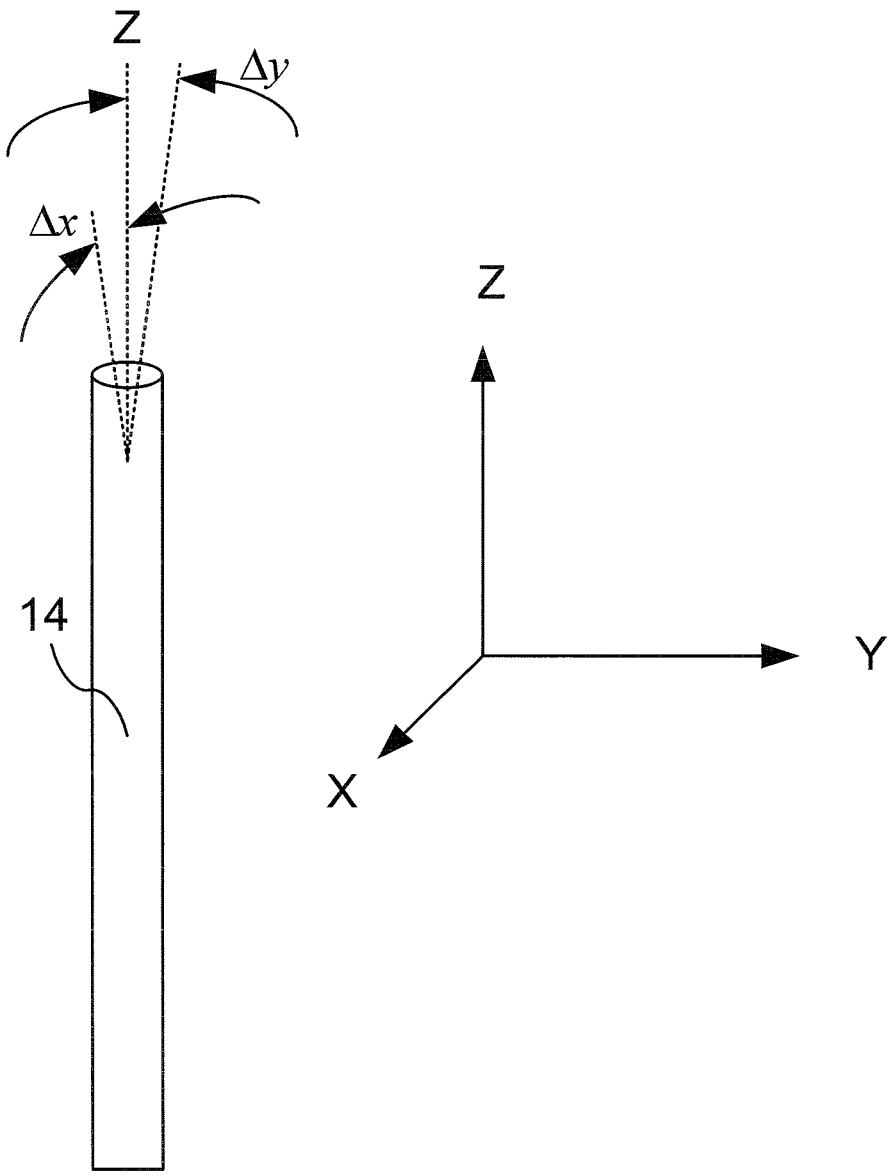
FIG. 2 is illustrates installation support deviation from vertical (Z-Axis) direction.

FIG. 2 depicts antenna support structure (14) which may not be vertically oriented. In most cases it might be difficult, and/or readily impractical to determine if the support structure is vertical due to many factors. Thus, it is highly desirable to have an antenna having built in capabilities that can compensate for a non vertical support structure.

FIG. 3A-C present a top view of a two way antenna (10) mounted on a vertically oriented pole (14). In this exemplary installation top mounting bracket (16) is attached to antenna back bone (26) support element. A conventional antenna array (20) is comprised of a plurality radiating elements (24) attached to the front side of reflector plane (22). Azimuth angle variation is achieved by attaching antenna array (20) with pivot joints (32), which allow a degree of azimuth rotation, to antenna back bone (26) support element. Azimuth rotation is provided by electromechanical actuator (30), such as an electrical motor coupled to gear track (28) with appropriate positional feedback (not shown). Alternative antenna construction techniques and elements are possible as well known to those skilled in the art.

In FIG. 4A-B effects of the vertical deviation (deviation from vertical Z-Axis) of the support structure (14) on the antenna coverage footprint are presented. FIG. 4A is used to demonstrate antenna radiation footprint coverage afforded by a (an ideal) vertical antenna support structure (14) in the immediate service sector. Footprint coverage remains uniform regardless of the azimuth settings (50, 52, 54). But in contrast, FIG. 4B shows effects of the non-vertically oriented support structure (14) on the antenna footprint coverage (52*a*, 54*a*) vs. vertically oriented (52, 54).

Figure 5:
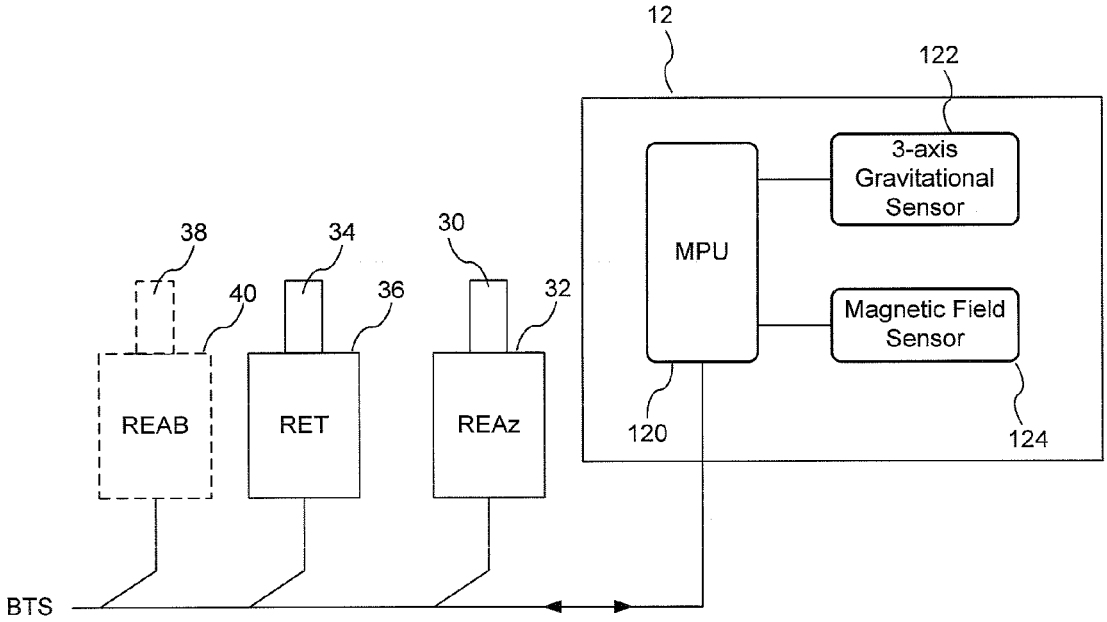
FIG. 5 is a control system of the antenna of the present invention depicting principal control elements for providing positional information back to BTS and antenna actuator controls.

In FIG. 5 antenna control elements and APS (12) are presented. APS module (12) is comprised of a microprocessor unit, MPU (120), tri-axis gravitational sensor (122) and magnetic field sensor (124). MPU (120) also provides communication to and from APS (12) via a suitable interface. Antenna orientation is provided by remote electrical tilt (RET) actuator (36) interface, while azimuth heading is controlled by remote electrical azimuth (REAz) actuator (32) interface. Optionally, antenna azimuth beamwidth can be altered via remote electrical azimuth beamwidth (REAB) actuator (40) interface. These modules provide communication to and from BTS (base station) controller (not shown) and translate remote commands into appropriate mechanical displacement (38, 34, 30). As such, BTS controller (not shown) performs computational correction based on data supplied from APS module.

Figure 6:
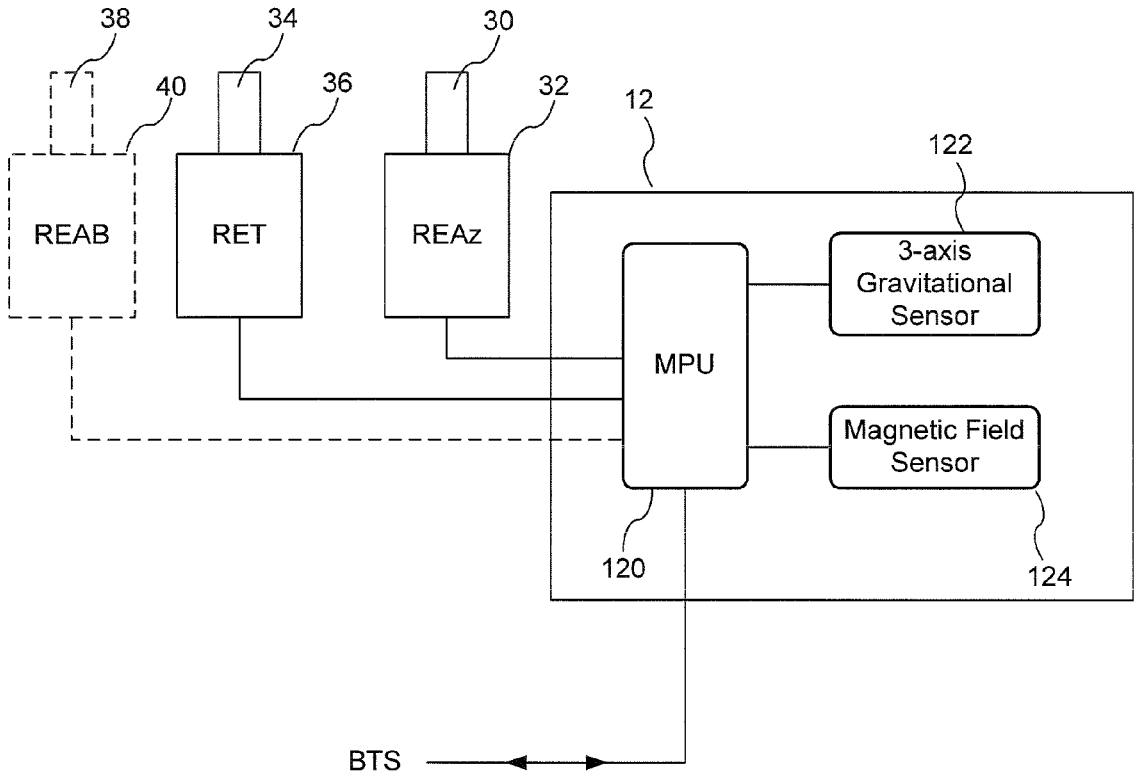
FIG. 6 is a self contained antenna control system of the antenna of the present invention providing compensation means to antenna actuator controls based on observed positional information.

FIG. 6 provides an alternative control configuration which does not rely on a BTS controller (not shown) to perform compensation required to compensate for a non-vertical support structure. In this configuration MPU (120) performs positional offset based on positional information supplied by tri-axis gravitational sensor (122) and magnetic field sensor (124). MPU (120) also provides communication interface to respective control elements (36, 32, 40) of the antenna.

It is well known that the earth's magnetic field is globally non-uniform and has both vertical and horizontal vector components. APS (12) preferably utilizes the horizontal component of the magnetic field after being transposed into true horizontal plane. Thereafter, the transposed magnetic field vector can be used to determine relative azimuth antenna orientation. An MPU (120) performs magnetic field vector transform into a horizontal coordinate system as determined by tri-vector gravitational (122) sensor.

Antenna azimuth orientation relies on the earth magnetic field which is subject to local disturbances, such as strong electro magnetic fields and or nearby ferrous materials. However, above the mentioned magnetic field variations can be readily compensated during initial installation by referencing out their effects against known nearby landmarks.

In view of the above it will be appreciated that the present invention provides a number of features and aspects. The foregoing description should not be viewed as limiting in nature as various additional implementations and modifications will be apparent to those skilled in the art.

What is claimed is:

1. An antenna system, comprising;

an antenna support structure;

an antenna including one or more radiating elements;

an antenna mounting structure coupling the antenna to the antenna support structure, the antenna mounting structure including a movable mount allowing change of the antenna orientation; and an antenna position sensor module mounted on the antenna for detecting at least one of vertical and azimuth orientation relative to the earth, wherein the antenna orientation is adjustable in response to the detected orientation relative to the earth;

wherein said antenna system further comprises a radome and wherein said radiating elements and said antenna position sensor module are mounted in said radome, and wherein said antenna system further comprises an electromechanical actuator coupled to move the radome about the movable mount in response to a control signal.

2. An antenna system as set out in claim 1, wherein said antenna position sensor module comprises an earth gravitational field sensor detecting inclination of the module from vertical.

3. An antenna system as set out in claim 2, wherein the antenna orientation is adjusted in response to said detected inclination from vertical.

4. An antenna system as set out in claim 3, wherein said adjusting is responsive to a remotely provided tilt control signal.

5. An antenna system as set out in claim 3, wherein said antenna position sensor module further comprises a microprocessor for determining a tilt adjustment from said detected inclination and controlling said adjusting.

6. An antenna system as set out in claim 3, wherein said adjusting is responsive to a remotely provided azimuth control signal.

7. An antenna system as set out in claim 3, wherein said antenna position sensor module further comprises a microprocessor for determining an azimuth adjustment from said detected inclination and controlling said adjusting.

8. An antenna system as set out in claim 2, wherein the antenna azimuth orientation is adjusted in response to said detected inclination from vertical.

9. An antenna system as set out in claim 1, wherein said antenna position sensor module comprises an earth magnetic field sensor.

10. An antenna system as set out in claim 9, wherein said antenna position sensor further comprises a microprocessor for converting the detected magnetic field into a horizontal component which is used for deriving an azimuth orientation of the antenna.

11. An antenna system as set out in claim 1, wherein said antenna support structure comprises a pole.

12. An antenna system as set out in claim 1, wherein said electromechanical actuator comprises a motor and gear coupled to the radome.

13. An antenna orientation control system, comprising;

an orientation sensor for detecting orientation relative to the gravitational field of the earth; and an antenna orientation controller for providing control signals to control adjusting antenna orientation.

14. An antenna orientation control system as set out in claim 13, wherein the antenna orientation controller provides antenna tilt control signals.

15. An antenna orientation control system as set out in claim 13, wherein the antenna orientation controller provides antenna azimuth pointing direction control signals.

16. An antenna orientation control system as set out in claim 13, wherein the antenna orientation control system further comprises a microprocessor unit for receiving sensor output signals from the orientation sensor and converting them to said control signals.

17. An antenna orientation control system as set out in claim 13, further comprising a microprocessor unit for receiving sensor output signals from the orientation sensor and providing the signals to an external base station and wherein external control signals are received from the base station and provided to the antenna orientation controller.

18. A method for controlling the orientation of an antenna, comprising receiving sensor information corresponding to detected orientation relative to the earth's gravitational field; and adjusting the orientation of an antenna in response to the detected orientation relative to the earth.

* * * * *